US008409667B2

(12) United States Patent
Bordignon et al.

(10) Patent No.: US 8,409,667 B2
(45) Date of Patent: Apr. 2, 2013

(54) METHOD FOR CONTINUOUSLY ANNEALING AND PREPARING STRIP OF HIGH-STRENGTH STEEL FOR THE PURPOSE OF HOT-DIP GALVANISATING IT

(75) Inventors: Michel Bordignon, Sprimont (BE); Xavier Vanden Eynde, Latinne (BE)

(73) Assignee: Centre de Recherches Metallurgiques asbl, Broxelles (BE)

( * ) Notice: Subject to any disclaimer, the term of this patent is extended or adjusted under 35 U.S.C. 154(b) by 710 days.

(21) Appl. No.: 12/295,084

(22) PCT Filed: Mar. 13, 2007

(86) PCT No.: PCT/BE2007/000026

§ 371 (c)(1),
(2), (4) Date: Jul. 23, 2009

(87) PCT Pub. No.: WO2007/109865

PCT Pub. Date: Oct. 4, 2007

(65) Prior Publication Data

US 2010/0062163 A1 Mar. 11, 2010

(30) Foreign Application Priority Data

Mar. 29, 2006 (BE) ..... 2006/0201

(51) Int. Cl.
*C23C 2/02* (2006.01)

(52) U.S. Cl. ..... 427/321; 427/318

(58) Field of Classification Search ..... 427/321, 427/318

See application file for complete search history.

(56) References Cited

U.S. PATENT DOCUMENTS

| | | | | |
|---|---|---|---|---|
| 3,925,579 | A | 12/1975 | Flinchum et al. | |
| 3,966,351 | A * | 6/1976 | Sproule | 415/110 |
| 7,792,392 | B2 * | 9/2010 | Chen et al. | 385/12 |
| 2008/0057196 | A1 * | 3/2008 | Ishikawa et al. | 427/248.1 |

FOREIGN PATENT DOCUMENTS

| | | | |
|---|---|---|---|
| BE | 1 014 997 | A3 | 8/2004 |
| JP | 07 034210 | A | 2/1995 |
| JP | 2003342645 | A | 12/2003 |
| JP | 2004280925 | A | 10/2004 |
| JP | 2005023348 | * | 1/2005 |
| JP | 2005023348 | A | 1/2005 |
| JP | 2005068493 | A | 3/2005 |
| JP | 2005105399 | A | 4/2005 |

* cited by examiner

*Primary Examiner* — Timothy Meeks
*Assistant Examiner* — Nathan T Leong
(74) *Attorney, Agent, or Firm* — Reinhart Boerner Van Deuren P.C.

(57) ABSTRACT

The present application relates to a method for continuously annealing and preparing a strip of high-strength steel for the purpose of hot-dip coating it in a bath of liquid metal, in which said steel strip is treated in at least two sections, comprising in succession, when considering the direction of advance of the strip: a section called the heating and holding section, in which the strip is heated and then held at a given annealing temperature in an oxidizing atmosphere; and a section called the cooling and transfer section, in which the annealed strip at least is cooled and undergoes complete reduction, in a reducing atmosphere, of the iron oxide present in the oxide layer formed in the previous section, in such a way that the oxidizing atmosphere is separated from the reducing atmosphere, a controlled oxygen content is maintained in the heating and holding section between 50 and 1000 ppm, and a controlled hydrogen content is maintained in the cooling and transfer section at a value of less than 4% and preferably less than 0.5%.

14 Claims, No Drawings

METHOD FOR CONTINUOUSLY ANNEALING AND PREPARING STRIP OF HIGH-STRENGTH STEEL FOR THE PURPOSE OF HOT-DIP GALVANISATING IT

CROSS-REFERENCE TO RELATED PATENT APPLICATIONS

This patent application is the National Stage of International Application No. PCT/BE2007/000026, filed Mar. 13, 2007, that claims the benefit of Belgium Application No. 2006/0201, filed Mar. 29, 2006, the entire teachings and disclosure of which are incorporated herein by reference thereto.

FIELD OF THE INVENTION

The present invention relates to a new method for continuously annealing and preparing a strip of high-strength steel with a view to coating it by hot dipping in a bath of molten metal, preferably by galvanisation or a treatment known as "galvannealing."

The technical area considered here is that of the galvanisation in continuous motion, in a coating bath of zinc or of a zinc alloy, of high-alloy strips of steel, more particularly HSS steel (high strength steels). These special steels, reputed to be difficult to galvanise, are for example steels that may comprise a level of alloy elements (aluminium, manganese, silicon, chromium, etc.) of up to 2% or more, stainless steels, "dual phase", TRIP, TWIP (up to 25% Mn and 3% Al), etc. These steel strips are generally intended to be cut and formed at a later stage by pressing, folding, etc. for applications in the construction or automobile sector for example.

STATE OF THE ART

It is well known that some steels do not respond well to galvanisation or to a galvannealing treatment given their specific surface reactivity. The ability to galvanise essentially depends on the proper elimination of the residues of rolling oil and on the prevention of excessive surface oxidation before the immersion in the bath of molten metal. Thus, a lack of wettability of molten zinc on shades of high-alloy steels may be encountered during the continuous galvanisation process. This decrease in wetting of zinc is explained by the presence of a layer of selective oxides in the outer layer at the surface of the strip ("outermost surface"). These selective oxides are created by the segregation of the alloy elements and their oxidation by water steam during the continuous annealing prior to the immersion in the bath of zinc. The water steam is generated at this point by the reduction of iron oxide, always present in cold-rolled bars, by the hydrogen contained in the atmosphere of annealing furnaces.

Consequently, there have been attempts to eliminate the selective oxidation on the outside or to make it migrate to the inside of the steel, to 1 or 2 μm beneath the outer layer of the surface, in order to allow the presentation of a layer of practically pure metallic iron to the molten zinc, regardless of the alloy composition and favouring the attachment of the zinc or zinc-alloy coating. This result may be obtained by various methods:

- increasing the dewpoint while maintaining a high temperature (for example JP-A-2005/068493), in such a way as to shift the selective oxidation of the alloy elements from the outside to the inside;
- total oxidation of the iron during the heating stage by increasing e.g. the ratio of air/combustible gas in the direct flame burners of the furnace, then reduction by hydrogen to metallic iron while maintaining a high temperature (for example JP-A-2005/023348, JP-A-07 034210, etc.) or reduction by the free carbon of the steel which diffuses, if need be, through the oxide layer and exchanges oxygen on its surface (see for example BE-A-1 014 997);
- pre-deposition of iron or nickel (for example JP-A-04 280925, JP-A-2005/105399).

These methods generally entail working under steel-reducing atmosphere during the stage of maintaining at high temperature, which requires a low dewpoint and a high level of hydrogen (up to 75% of the gas of the atmosphere), which is an expensive gas. They all allow to improve the "galvanisability" of high-strength steels with significant but nevertheless insufficient efficiency, above all in the case of some steels with, for example, high silicon levels (about 1.5% by weight). Moreover, the methods requiring pre-deposition are very costly.

According to one example of a method already known in the state of the art, premises for annealing and preparing a steel strip for galvanisation typically comprise in the flow direction of the strip:

- a first (pre-)heating section to ensure the heating of the strip up to a temperature that allows to form an oxide film of suitable thickness (about 50 nanometers) for subsequent reduction; this section is under an atmosphere that was rendered oxidising by the addition of air or oxygen, for example in the form of an air/combustible gas mixture in the case of a direct-flame furnace or the addition of air only in the case of a radiant furnace;
- a second annealing section, separated from the heating section by a conventional airlock, where the strip is maintained at the high annealing temperature and that is under inert and over-pressurised atmosphere in order to prevent the penetration of the gases of the heating section;
- a third reduction section, also separated from the second section by a conventional airlock, under an atmosphere that is slightly depressurised compared with the preceding section but that is slightly over-pressurised relative to ambient pressure; this section is intended to complete the annealing cycle (end of the temperature-maintenance period), to cool the strip and possibly to cause overaging before it is transferred to the bath of molten metal through an immersion pump; in this zone, the oxide layer created in the first section is ideally completely reduced by a hydrogen/inert gas atmosphere with a very low dewpoint.

Of course, simpler or more complex annealing furnaces are also known that typically comprise between one and four separate sections for achieving the functions of (pre-)heating, temperature maintenance, cooling, overaging, etc., respectively.

Aims of the Invention

The present invention aims to provide a solution that allows to overcome the drawbacks of the state of the art.

In particular, the invention aims to provide a method for annealing and preparing high-strength steels for galvanisation that is more economical, the latter being achieved with or without accompanying heat treatment of a galvannealing type.

The invention also aims to allow the preparation of high-strength steels for galvanisation that are free of brittleness defects.

In particular, the invention aims to provide an annealing method under confined atmosphere that is free of added hydrogen.

One additional aim of the invention is to prevent the selective oxidation of alloy elements in the outermost layer of the strip surface during the total oxidation stage in the course of the continuous annealing preceding cooling and immersion in the bath of zinc.

Main Characteristic Features of the Invention

The present invention relates to a method for the continuous annealing and preparation of a strip of high-strength steel with a view to its hot-dip coating in a bath of molten metal, according to which said strip of steel is treated in at least two sections comprising successively, if considered in the flow direction of the strip:

- a "heating and temperature-maintenance" section in which the strip is heated, then maintained at a given annealing temperature under oxidising atmosphere with an air (or oxygen)/non-oxidising or inert gas mixture in order to form a thin oxide film on the surface of the strip, whose thickness, preferably between 0.02 and 0.2 μm, is controlled, said heating of the strip being achieved either by a direct flame or by radiation;
- a "cooling and transfer" section in which, before it is transferred into the coating bath, the strip, which is at least annealed, is cooled and undergoes complete reduction to metallic iron of the iron oxide present in the oxide layer formed in the heating and temperature-maintenance section, under reducing atmosphere with a mixture of low level of hydrogen and inert gas, both said sections being separated from each other by a conventional airlock;

wherein the oxidising atmosphere is at least partially separated from the reducing atmosphere, wherein a controlled level of oxygen is maintained in the heating and temperature-maintenance section at between 50 and 1,000 ppm and wherein a controlled level of hydrogen is maintained in the cooling and transfer section at a value lower than 4% and preferably lower than 0.5%.

Complete reduction of the iron oxide should be understood as its reduction of at least 98%.

As an advantage, the controlled oxygen level is maintained in the heating and temperature-maintenance section at between 50 and 400 ppm.

According to a first preferred embodiment of the invention, the oxidising atmosphere is separated from the reducing atmosphere by over-pressurising the oxidising atmosphere so that the oxygen introduced by the strip into the cooling and transfer zone through the airlock completely reacts, because of this overpressure, with the hydrogen contained in the cooling atmosphere by forming steam.

According to a second preferred embodiment of the invention, the hydrogen present in the cooling and transfer section, introduced into the hot gaseous flow directed upstream, is allowed to react with the oxygen coming from the heating and temperature-maintenance section in order to form steam. In this case, the cooling and transfer section is maintained at overpressure compared with the heating and temperature-maintenance section. Since the high-pressure gas cannot escape towards the bath of molten metal, it returns to the heating and temperature-maintenance zone.

According to the invention, the control of the oxygen content of the oxide layer formed in the heating and temperature-maintenance section is obtained either by modifying the gaseous mixture with the combustion air feeding the direct-flame heating means or by controlled injection of the air (or oxygen)/inert gas mixture in the case of radiation or induction heating.

The non-oxidising or inert gas is preferably nitrogen or argon.

As an advantage, the molten metal is zinc or one of its alloys.

As a further advantage, the heating and temperature-maintenance zone is free of any reducing atmosphere.

The method for hot-dip coating is preferably galvanisation or a galvannealing treatment.

Still according to the invention, the atmosphere both in the heating and temperature-maintenance section and in the cooling and transfer section has a dewpoint lower than or equal to −10° C. and preferably −20° C.

According to a preferred embodiment, the strip is heated up to a temperature between 650° C. and 1,200° C., which includes the maintenance temperature.

According to another preferred embodiment, the strip is then cooled to a temperature higher than 450° C. at a cooling speed between 10 and 100° C./s.

DESCRIPTION OF A PREFERRED EMBODIMENT OF THE INVENTION

One economical method, proposed according to the invention, aims to implement the annealing stage in preparation for galvanisation without the addition of hydrogen, a gas which is ten times as expensive as a more common gas such as nitrogen and which is moreover the cause of serious brittleness defects in strong steels.

The invention aims to achieve perfect galvanisation for all shades of strong steel. To prevent oxidation of the alloy elements on the outermost surface, one proposal is to inject an air/nitrogen mixture into the furnace during the entire cycle of (pre-)heating and maintenance of the bar at high temperature.

This method therefore does not require the separation of the atmosphere in the entire heating/temperature-maintenance part, as is the case in other methods (for example JP-A-2003/342645) where low-pressure reactive zones are incorporated into this part of the furnace.

The oxygen of the air/nitrogen mixture will have the effect of creating two simultaneous and competing reactions in the annealing section:

- oxidation of the iron by the oxygen on the outermost surface with an increase in the iron oxide by the diffusion of iron at the surface. Thus, as long as a thin layer of iron oxide persists on the surface of the bar, the alloy elements, with the exception of manganese, are blocked at the steel/iron oxide interface;
- subsequent reduction of the iron oxide by diffusion of the free carbon towards the steel/iron oxide interface.

The alloy elements also participate in the reduction of the iron oxide when they migrate to the steel/iron oxide interface.

The air/nitrogen atmosphere of the heating/temperature-maintenance part must however be separated and partially isolated from the non-oxidising atmosphere of the strip cooling and transfer stages as far as the bath of zinc. To this end, the oxidising atmosphere will preferably be maintained at high pressure compared with the non-oxidising atmosphere in such a way that the oxygen introduced by the bar completely reacts with the hydrogen contained in the atmosphere of the cooling section.

In such a configuration, a steel comprising i.a. 1.2% aluminium will, for example, be heated and annealed to a temperature of 800° C. in an atmosphere with 100 ppm of oxygen in nitrogen. At the end of the temperature maintenance, which lasts one minute, the bar is cooled to 500° C. at a speed of 50° C./s in an atmosphere with 4% hydrogen and 0.1% water steam, which corresponds to a dewpoint of −20° C. This bar is then immersed at a temperature of 470° C. into a bath of zinc with 0.2% aluminium and maintained at 460° C. After a 3-second immersion, the coating is wringed so as to leave an 8-μm zinc layer. Such a zinc deposit is then perfectly wetting and has adherence qualities that are comparable to those obtained for an ordinary low-carbon steel.

To cite another example, the same method may be applied to a steel with i.a. 1.5% silicon. However, in this case, it will be necessary to increase the oxygen level to 300 ppm during the heating/temperature-maintenance stage in order to obtain a comparable result. This increase in the oxygen level is necessary since silicon delays the diffusion of iron by providing a silicon oxide barrier at the steel/iron oxide interface.

Another way of working is to allow the usual flow to establish itself from the bath of zinc to the heating section and to allow the very low level of hydrogen (<0.5%) of the transfer/cooling section to react with the oxygen of the heating/temperature-maintenance part in order to form water steam. Extra oxygen may be added at the exit from the temperature-maintenance section to neutralise the entry of hydrogen, the levels implemented always being positioned very far from the danger zone, i.e. the explosive zone (4% $H_2$ in the air).

Indeed, a high hydrogen level is not necessary in the cooling section since the carbon of the steel will be sufficient to reduce the thin layer of iron oxide created in the heating/temperature-maintenance part and the metallic iron thus prepared will ensure good wettability by zinc during the immersion of the bar in the bath.

To be effective, this method will have to provide a means for controlling the oxygen level in the furnace within the range of 50 to 1,000 ppm. In fact, a too-low level will not allow to create a layer of iron oxide sufficiently impervious to the diffusion of the alloy elements towards the outermost surface and a too-high level of oxygen will produce a too-thick iron-oxide layer that will not be reduced during the cooling and transfer stages leading towards the bath of zinc. This oxygen level will preferably be within a range of 50 to 400 ppm.

The present invention has a certain number of advantages, including in particular the fact that:

- far less hydrogen than in the state of the art, and perhaps even none, is added in the heating/temperature-maintenance zone, which represents major operational saving and guarantees the production of a high-strength steel with fewer brittleness defects;
- the heating section is no longer separated from the section in which the annealing temperature is maintained, which allows to dispense with an airlock as well as to avoid any duplication of the control equipment for the gaseous atmosphere;
- this method is much more effective than the methods known in the state of the art as regards the adherence of the coating or the wettability of the strip;
- the gaseous atmosphere used is less damaging to the equipment (e.g. the radiant tubes), in particular following the reduction of its hydrogen level.

The invention claimed is:

1. A method for preparing a strip of high-strength steel for galvanisation comprising the steps:

heating a strip of steel to an annealing temperature and holding the strip at said annealing temperature, under an oxidising atmosphere of a mixture of a) air or oxygen, and b) a non-oxidizing or inert gas to form an oxide film on the surface of the strip, oxide film comprising iron oxide, said heating of the strip being achieved either by direct flame or by radiation; and cooling the annealed strip and reducing the iron oxide present in the oxide film of the annealed strip under a reducing atmosphere of a mixture of a) hydrogen and b) a second inert gas;

wherein the oxidising atmosphere is at least partially separated from the reducing atmosphere, wherein a controlled oxygen level is maintained between 50 and 1,000 ppm during the heating and holding step, and wherein a controlled hydrogen level is maintained in the cooling and reducing step at a value lower than 0.5% volume in the second inert gas.

2. A method as in claim 1, wherein the controlled oxygen level in the heating and holding step is maintained between 50 and 400 ppm.

3. A method as in claim 1, wherein the oxidizing atmosphere is separated from the reducing atmosphere by overpressurising the oxidizing atmosphere so that the air or oxygen introduced to the strip completely reacts with the hydrogen of the cooling atmosphere to form steam.

4. A method as in claim 1, wherein the hydrogen is present at a pressure higher than a pressure maintained in the heating and holding step, the hydrogen introduced upstream relative to the strip, wherein the hydrogen reacts with the oxygen from the heating and holding step so as to form steam.

5. A method as in claim 1, wherein the control of the oxygen level is achieved either by modifying the oxidation atmosphere with combustion air feeding the direct-flame, or by controlling injection of the oxidation atmosphere mixture during radiation heating.

6. A method as in claim 1, wherein the nonoxidising or inert gases are independently nitrogen or argon.

7. A method as in claim 1, wherein the strip of high-strength steel is hot-dipped in a bath of a molten metal, the molten metal selected from the group consisting of zinc or an alloy of zinc.

8. A method as in claim 7, wherein the hot-dip step is galvanisation or a galvannealing treatment.

9. A method as in claim 1, wherein the heating step is free of any reducing atmosphere.

10. A method as in claim 1, wherein both the oxidising atmosphere and the reducing atmosphere have a dewpoint lower than or equal to −10° C.

11. A method as in claim 1, wherein the strip is heated to an annealing temperature of between 650° C. and 1,200° C.

12. A method as in claim 11, wherein the strip is cooled to a temperature higher than 450° C. at a cooling speed between 10 and 100° C./s.

13. A method as in claim 1, wherein the oxide film is between 0.02 and 0.2 μm thick.

14. A method as in claim 10, wherein both the oxidising atmosphere and the reducing atmosphere have a dewpoint lower than or equal to −20° C.

* * * * *